US011278769B2

(12) United States Patent
Houghton

(10) Patent No.: US 11,278,769 B2
(45) Date of Patent: Mar. 22, 2022

(54) PICKLEBALL COLLECTION AND STORAGE DEVICE

(71) Applicant: Karin Houghton, Westborough, MA (US)

(72) Inventor: Karin Houghton, Westborough, MA (US)

( * ) Notice: Subject to any disclaimer, the term of this patent is extended or adjusted under 35 U.S.C. 154(b) by 0 days.

(21) Appl. No.: 17/010,512

(22) Filed: Sep. 2, 2020

(65) Prior Publication Data

US 2021/0060390 A1 Mar. 4, 2021

Related U.S. Application Data

(60) Provisional application No. 62/895,259, filed on Sep. 3, 2019.

(51) Int. Cl.
*A63B 47/02* (2006.01)

(52) U.S. Cl.
CPC ..... *A63B 47/02* (2013.01)

(58) Field of Classification Search
CPC ..... A63B 47/02; A63B 47/00; A63B 2209/08
See application file for complete search history.

(56) References Cited

U.S. PATENT DOCUMENTS 1,411,451 A * 4/1922 Mygind ..... A63B 67/10 473/576
2,196,253 A * 4/1940 Di Bella ..... A63B 67/22 473/507
2,950,113 A * 8/1960 Barnack ..... A63B 67/20 273/330
3,148,883 A * 9/1964 Ruderian ..... A63B 67/20 273/330
D445,147 S * 7/2001 Saldana ..... D21/466
8,701,987 B2 * 4/2014 Albers ..... A63B 67/20 235/380
8,899,589 B2 * 12/2014 Kueng ..... A63B 67/22 273/330
2009/0298619 A1 * 12/2009 Tice ..... A63B 69/0088 473/425

* cited by examiner

*Primary Examiner* — Stephen L Blau
(74) *Attorney, Agent, or Firm* — Genius Patent APC; Bruce Angus Hare

(57) ABSTRACT

A pickleball collection and storage device includes a paddle, a collection line coupled to the paddle, and multiple pickleballs, where the collection line secures the pickleballs to the paddle by passing through at least two through-holes of each pickleball. A pickleball collection and storage device includes: a paddle having a generally rectangular face, rounded ends and tapered sides; a collection line coupled to the paddle, a notch including a lip and a tapered channel; and multiple pickleballs, where the collection line secures the pickleballs to the paddle by passing through at least two holes of each pickleball. A pickleball collection and storage device includes: a flat rectangular body; a collection line coupled to the body; and a carry handle coupled to the flat rectangular body, the carry handle including a loop of flexible string, where the flat rectangular body includes a tie-off that accepts a portion of the collection line.

7 Claims, 4 Drawing Sheets

PICKLEBALL COLLECTION AND STORAGE DEVICE

CROSS-REFERENCE TO RELATED APPLICATIONS

This application claims priority to U.S. Provisional Patent Application Ser. No. 62/895,259, filed on Sep. 3, 2019.

BACKGROUND

Many people play pickleball for recreational or competitive purposes. During play, multiple pickleball balls may be utilized. Therefore, there exists a need to collect and store pickleballs.

BRIEF DESCRIPTION OF THE SEVERAL VIEWS OF THE DRAWINGS

The novel features of the disclosure are set forth in the appended claims. However, for purpose of explanation, several embodiments are illustrated in the following drawings.

DETAILED DESCRIPTION

The following detailed description describes currently contemplated modes of carrying out exemplary embodiments. The description is not to be taken in a limiting sense, but is made merely for the purpose of illustrating the general principles of some embodiments, as the scope of the disclosure is best defined by the appended claims.

Various features are described below that can each be used independently of one another or in combination with other features. Broadly, some embodiments generally provide a pickleball collection and storage device.

A first exemplary embodiment provides a pickleball collection and storage device including: a paddle; and a collection line coupled to the paddle.

A second exemplary embodiment provides a pickleball collection and storage device including: a generally rectangular paddle having rounded ends and tapered sides; and a collection line coupled to the generally rectangular paddle.

A third exemplary embodiment provides a pickleball collection and storage device including: a flat rectangular body; a collection line coupled to the flat rectangular body; and a carry handle coupled to the flat rectangular body, where the flat rectangular body comprises a tie-off that accepts a portion of the collection line.

Figure 1:
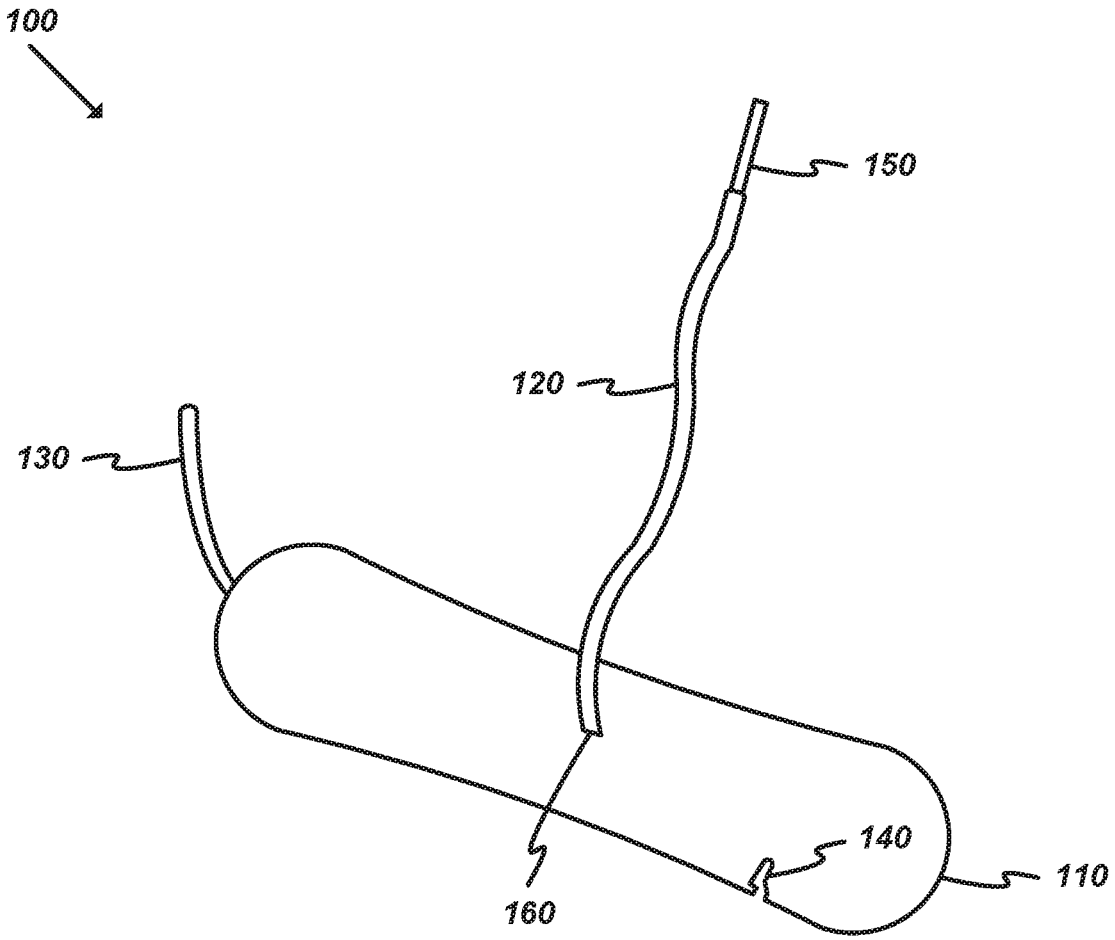
FIG. 1 illustrates a perspective view of a pickleball collection and storage device according to an exemplary embodiment.

FIG. 1 illustrates a perspective view of a pickleball collection and storage device 100 according to an exemplary embodiment. As shown, the pickleball collection and storage device 100 may include a body or "paddle" 110, a collection line 120, a handle 130, and a tie-off 140.

The paddle 110 may be made from a rigid or semi-rigid material (e.g., plastic, metal, wood, etc.) or combination of materials. The paddle 110 may be sized to be larger than the circular holes in the surface of a pickleball ball such that the paddle is not able to pass through the circular holes. The paddle may have a generally flat shape with an appropriate thickness for comfortable handling, storage of an appropriate number of pickleball balls, and sufficient rigidity. As shown, the paddle 110 may have a tapered shape (similar to the shape of a pickle) such that the protruding string may be wrapped around the paddle for convenient storage when not in use, or in order to secure one or more pickleballs to the paddle during collection and/or storage. The paddle 110 may be two to four inches wide and six to fifteen inches long in some embodiments.

Paddle 110 may have a generally rectangular shape with two "ends" having a rounded convex shape, as shown. The generally rectangular shape may include two "sides" with a rounded concave shape that tapers to a narrower "waist" near the center or middle of paddle 110, as shown.

The collection line 120 may include a protruding line, string, rope, or other flexible material (e.g., leather, rubber, plastic, silicone, etc.). The collection line 120 may include a knotted, shrink wrapped, metal-tipped, or otherwise finished end 150 such that the collection line 120 is protected against unraveling, fraying, and/or other wear. The collection line 120 may have a length of about five feet in some embodiments, with a diameter of about three-eighths of an inch. The collection line 120 and collection line end 150 (if any) may be sized such that the collection line 120 is able to pass through the circular holes in the surface of a pickleball ball.

The collection line 120 may be coupled to the paddle 110 at a paddle-line coupling 160. The end of the collection line 120 coupled to the paddle 110 may be referred to as the "anchor" end, whereas the opposite end of the collection line 120 may be referred to as the "free" end. The paddle-line coupling 160 may include various appropriate complementary or independent elements or features that may be able to secure the collection line 120 to the paddle 110. The paddle-line coupling 160 may be located near the center or middle of paddle 110, as shown. For instance, the paddle-line coupling 160 may include a through-hole in the paddle 110 and one or more knots in the collection line 120. As another example, the collection line 120 may be fused to the paddle 110 during molding of the paddle 110. The paddle-line coupling 160 may include adhesives, staples, pins, hooks, eyes, clips, buckles, slots, holes, etc. In addition to, or in place of, features included at the paddle 110, the collection line 120 may include various complementary or independent features of the paddle-line coupling 160. For instance, the collection line 120 may include knots, hooks, clips, etc. In addition, the collection line 120 of some embodiments may include embedded or integrated elements of paddle-line coupling 160, such as rigid or semi-rigid paddles, buttons, plates, pins, tabs, etc.

In some embodiments, the pickleball collection and storage device 100 may include a handle (or "carry handle") 130 or other feature for convenient transport of the pickleball collection and storage device 100, whether loaded or unloaded with pickleball balls. The handle 130 may include various appropriate features, such as the example loop of string, as shown. The handle 130 may be attached to the paddle 110 in various appropriate ways and may include various appropriate features for comfortable handling or other use by pickleball players. Such features may include, for instance, strings, straps, ropes, etc. As another example, such features may include rigid or semi-rigid knobs, "U" or "L" brackets, cylindrical protrusions, etc. In some embodiments, the paddle 110, or one or more portions thereof may serve as the handle 130. For instance, a player may grasp one end of the paddle 110 (e.g., the end associated with handle 130 in the example of FIG. 1) and tie-off the collection line 120 at an opposite end of the paddle 110 (e.g., the end opposite handle 130).

Some embodiments of the pickleball collection and storage device 100 may include a clip or other attachment feature for securing the pickleball collection and storage device 100 to a duffel bag, racquet bag, clothing, etc. In some embodiments, the handle 130 may serve as a hanging loop or include other appropriate feature for securing the pickleball collection and storage device 100 to a wall hook, fence, net, or other appropriate resource associated with a pickleball court or facility.

The pickleball collection and storage device 100 may include a notch or other collection line retention feature 140 in some embodiments. The notch 140 may be able to secure line 120 when wrapped around paddle 110. In this example, the notch 140 has a lip or catch and a tapered channel. Some embodiments may include other collection line retention features, such as magnets, holes, eyes, posts, cleats, hooks, slots, buttons, clasps, etc. In some embodiments, as described above, one or more portions of the paddle 110 may provide line retention features, such as allowing the collection line to be wrapped around a portion of the paddle.

The pickleball collection and storage device 100, and/or components thereof, such as the collection line 120, may be referred to as "pickle floss" or "pickleball floss".

Figure 2:
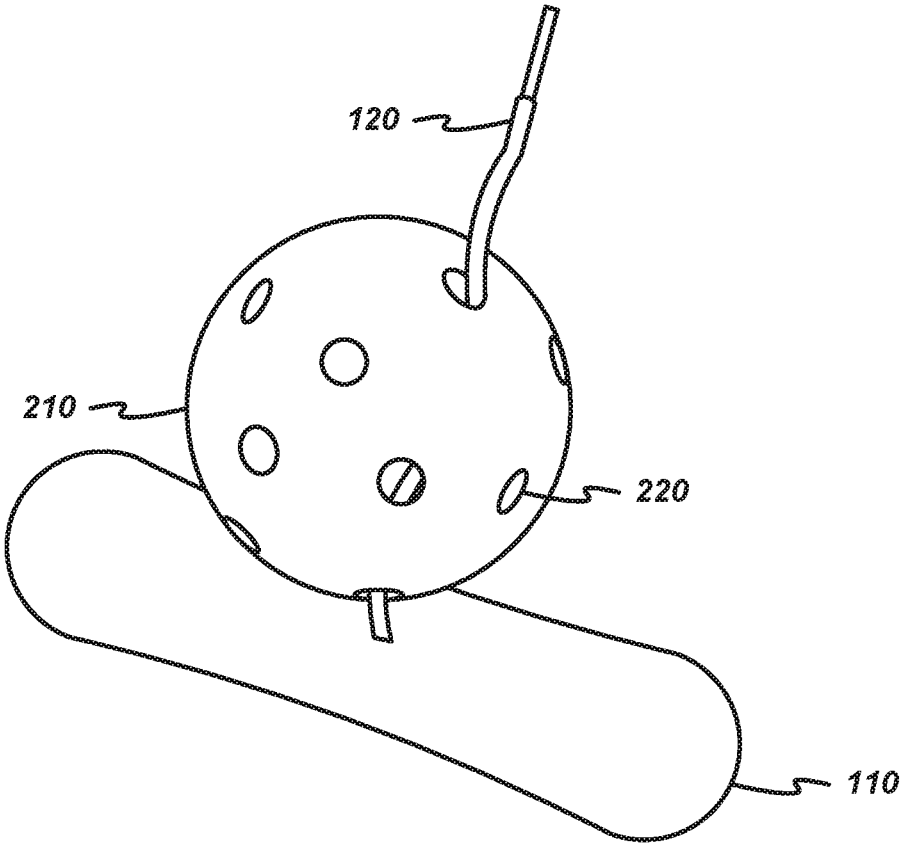
FIG. 2 illustrates a perspective view of the pickleball collection and storage device of FIG. 1, as used to collect and/or store a pickleball ball.

FIG. 2 illustrates a perspective view of the pickleball collection and storage device 100, as used to collect and/or store a pickleball ball 210. Pickleball balls (or "pickleballs") are generally spherical with a diameter between seventy-three millimeters and seventy-five-and-a-half millimeters and made of durable material molded with a smooth surface. Each pickleball has a minimum of twenty-six and a maximum of forty circular holes in the outer surface of the pickleball. The radius of each circular hole may be less than about one-half inch.

During use, the collection line 120 may pass through two or more holes 220 of the pickleball 210, allowing the pickleball 210 to slide along collection line 120 until the pickleball 210 engages the surface of the paddle 110. Additional pickleballs 210 may be collected and stored in a similar way until the remaining portion of collection line 120 is tied off or otherwise secured (e.g., using a feature such as notch 140) to the paddle 110. The collection line 120 may be unwrapped or otherwise released from the paddle 110 in order to release one or more of the stored pickleballs 210 for use.

Figure 3:
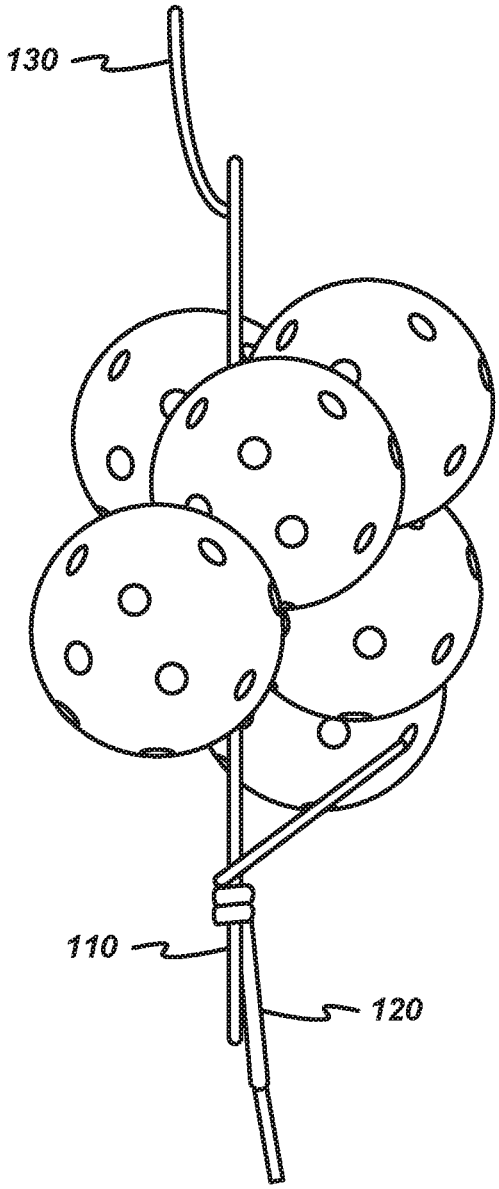
FIG. 3 illustrates a left side view of the pickleball collection and storage device of FIG. 1, as used to store multiple pickleball balls.

FIG. 3 illustrates a left side view of the pickleball collection and storage device 100, as used to store multiple pickleball balls 210. In this view, the top and bottom of the pickleball collection and storage device 100 may be referred to as "ends" of the generally rectangular shape and may be rounded as described above, while the near and far surfaces or edges may be referred to as "sides" may have a concave tapered shape as described above. Further, in this view, the right and left surfaces of the paddle 110 may be referred to as the "face" and the "rear" or "back". In this example, collection line 120 may be passed through each of multiple pickleballs 210 and wrapped around the paddle 110 as shown.

Figure 4:
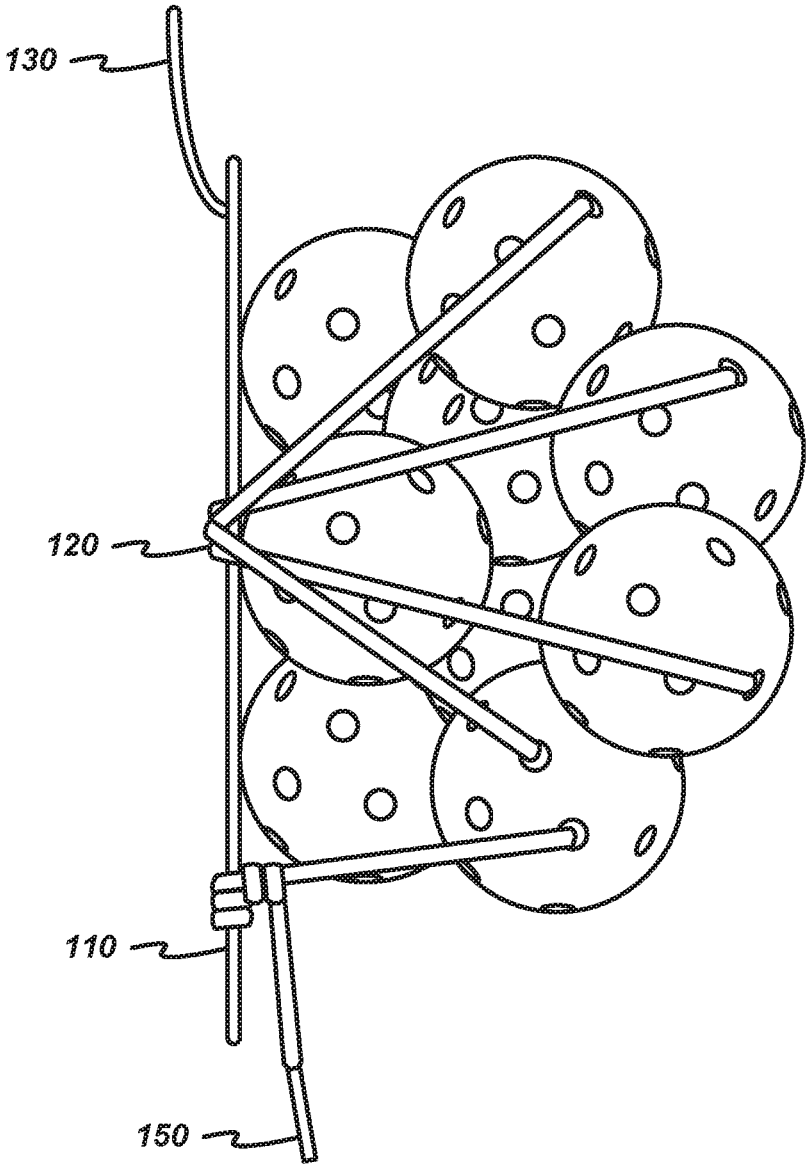
FIG. 4 illustrates a left side view of the pickleball collection and storage device of FIG. 1, as used to store multiple pickleball balls in an alternative configuration.

FIG. 4 illustrates a left side view of the pickleball collection and storage device 100, as used to store multiple pickleball balls in an alternative configuration. In this example, the collection line may be passed through one or more pickleballs 210, wrapped around the paddle 110, passed through one or more additional pickleballs 210, wrapped around the paddle 110, and so on, as shown, before being wrapped around the paddle 110 to secure the collection line 120.

One of ordinary skill in the art will recognize that pickleball collection and storage device 100 may be implemented in various different ways without departing from the scope of the disclosure. For instance, one end of the paddle 110 may include an elongated flat or cylindrical member extending out to form a grip or handle for the pickleball collection and storage device 100.

In addition, the various elements shown in the drawings may not be drawn to scale, may be stylized, and/or may not otherwise represent actual dimensions and features of some embodiments of the pickleball collection and storage device 100.

No element or act used in the present application should be construed as critical or essential unless explicitly described as such. An instance of the use of the term "and," as used herein, does not necessarily preclude the interpretation that the phrase "and/or" was intended in that instance. Similarly, an instance of the use of the term "or," as used herein, does not necessarily preclude the interpretation that the phrase "and/or" was intended in that instance. Also, as used herein, the article "a" is intended to include one or more items and may be used interchangeably with the phrase "one or more." Where only one item is intended, the terms "one," "single," "only," or similar language is used. Further, the phrase "based on" is intended to mean "based, at least in part, on" unless explicitly stated otherwise.

The foregoing relates to illustrative details of exemplary embodiments and modifications may be made without departing from the scope of the disclosure. Even though particular combinations of features are recited in the claims and/or disclosed in the specification, these combinations are not intended to limit the possible implementations of the disclosure. In fact, many of these features may be combined in ways not specifically recited in the claims and/or disclosed in the specification. For instance, although each dependent claim listed below may directly depend on only one other claim, the disclosure of the possible implementations includes each dependent claim in combination with every other claim in the claim set.

I claim:

1. A pickleball collection and storage device comprising:

a paddle;

a collection line coupled to the paddle; and a plurality of pickleballs, each pickleball in the plurality of pickleballs comprising a plurality of through-holes, wherein the collection line secures the plurality of pickleballs to the paddle by passing through at least two through-holes of each pickleball in the plurality of pickleballs.

2. The pickleball collection and storage device of claim 1 further comprising a tie-off notch in the paddle able to secure a portion of the collection line.

3. The pickleball collection and storage device of claim 1 further comprising a carry handle.

4. The pickleball collection and storage device of claim 1, wherein the paddle has a generally flat rectangular shape with convex rounded ends.

5. The pickleball collection and storage device of claim 4, wherein two sides of the generally flat rectangular shape have a rounded concave shape that tapers to a reduced width waist.

6. A pickleball collection and storage device comprising:

a paddle having a generally rectangular face, rounded ends, and tapered sides;

a collection line coupled to the generally rectangular face of the paddle;

a tie-off notch comprising a lip and a tapered channel; and a plurality of pickleballs, wherein the collection line secures the plurality of pickleballs to the paddle by passing through at least two holes of each pickleball in the plurality of pickleballs.

7. A pickleball collection and storage device comprising:

a flat rectangular body;

a collection line coupled to the flat rectangular body; and a carry handle coupled to the flat rectangular body, the carry handle comprising a loop of flexible string, wherein the flat rectangular body comprises a tie-off that accepts a portion of the collection line.

* * * * *